US007913897B2

(12) United States Patent
Manaige

(10) Patent No.: US 7,913,897 B2
(45) Date of Patent: Mar. 29, 2011

(54) CARTON WITH RECLOSABLE DISPENSER

(75) Inventor: Tim Manaige, Maplewood, MN (US)

(73) Assignee: Graphic Packaging International, Inc., Marietta, GA (US)

( * ) Notice: Subject to any disclaimer, the term of this patent is extended or adjusted under 35 U.S.C. 154(b) by 547 days.

(21) Appl. No.: 11/951,792

(22) Filed: Dec. 6, 2007

(65) Prior Publication Data

US 2008/0135605 A1 Jun. 12, 2008

Related U.S. Application Data

(60) Provisional application No. 60/873,745, filed on Dec. 8, 2006.

(51) Int. Cl.

| | |
|---|---|
| ***B65D 3/00*** | (2006.01) |
| ***B65D 5/56*** | (2006.01) |
| ***B65D 5/00*** | (2006.01) |
| ***B65D 5/74*** | (2006.01) |
| ***B65D 5/72*** | (2006.01) |

(52) U.S. Cl. ..... 229/217; 229/117.3; 229/215; 229/122; 229/125.42

(58) Field of Classification Search ..... 229/217, 229/215, 117.3, 122, 125.42, 117.27, 117.35
See application file for complete search history.

(56) References Cited

U.S. PATENT DOCUMENTS

| | | | | |
|---|---|---|---|---|
| 1,772,625 | A | | 8/1930 | Caulfield |
| 2,192,722 | A | | 3/1940 | Vogt |
| 2,355,665 | A | | 8/1944 | Mabee |
| 2,475,677 | A | * | 7/1949 | Ringler ..... 229/215 |
| 2,509,289 | A | * | 5/1950 | Dunning ..... 229/215 |
| 3,133,688 | A | * | 5/1964 | Asman ..... 229/215 |
| 3,355,089 | A | | 11/1967 | Champlin |
| 3,363,822 | A | | 1/1968 | Maulini et al. |
| 3,426,955 | A | | 2/1969 | Olson |
| 3,669,345 | A | | 6/1972 | Cote |
| 3,680,766 | A | | 8/1972 | Collura et al. |
| 3,690,544 | A | | 9/1972 | Meyers |
| 3,768,719 | A | | 10/1973 | Johnson |
| 4,344,537 | A | | 8/1982 | Austin |
| 4,508,218 | A | | 4/1985 | Focke et al. |
| 4,558,785 | A | | 12/1985 | Gordon |
| 4,645,108 | A | | 2/1987 | Gavin et al. |
| 4,676,394 | A | | 6/1987 | Hiersteiner |
| 4,905,898 | A | | 3/1990 | Wade |
| 5,292,058 | A | * | 3/1994 | Zoss et al. ..... 229/123 |
| 5,347,865 | A | | 9/1994 | Mulry et al. |
| 5,632,402 | A | | 5/1997 | Walsh et al. |
| 5,632,404 | A | | 5/1997 | Walsh |
| 5,746,871 | A | | 5/1998 | Walsh |
| 5,783,030 | A | | 7/1998 | Walsh |
| 5,794,811 | A | | 8/1998 | Walsh |
| 5,794,812 | A | | 8/1998 | Walsh |

(Continued)

FOREIGN PATENT DOCUMENTS

DE 29 23 455 A1 12/1980

(Continued)

*Primary Examiner* — Gary E Elkins
*Assistant Examiner* — Latrice Byrd
(74) *Attorney, Agent, or Firm* — Womble Carlyle Sandridge & Rice, PLLC

(57) ABSTRACT

A carton includes a reclosable dispenser that allows a top end of the carton to be accessed and subsequently reclosed. The sides of the carton can be pressed together to vary the size of the dispenser opening.

19 Claims, 8 Drawing Sheets

U.S. PATENT DOCUMENTS

| | | | | |
|---|---|---|---|---|
| 5,857,614 | A | 1/1999 | Walsh | |
| 5,918,799 | A | 7/1999 | Walsh | |
| 6,050,484 | A * | 4/2000 | Galomb | 229/222 |
| 6,062,467 | A | 5/2000 | Ours et al. | |
| 6,102,277 | A | 8/2000 | Krapohl, Sr. | |
| 6,145,736 | A | 11/2000 | Ours et al. | |
| 6,206,279 | B1 * | 3/2001 | Countee | 229/117.27 |
| 6,352,096 | B1 | 3/2002 | Walsh | |
| 6,364,202 | B1 | 4/2002 | Zelley | |
| 6,419,151 | B1 * | 7/2002 | Urtubey | 229/215 |
| 6,854,639 | B2 | 2/2005 | Walsh | |
| 7,025,504 | B2 | 4/2006 | Olin | |
| 7,036,714 | B2 * | 5/2006 | Walsh et al. | 229/117.27 |
| 7,210,612 | B2 * | 5/2007 | Walsh et al. | 229/117.27 |
| 2001/0048022 | A1 | 12/2001 | Zoeckler | |
| 2002/0055429 | A1 | 5/2002 | Walsh | |
| 2003/0144121 | A1 | 7/2003 | Walsh et al. | |
| 2004/0226989 | A1 | 11/2004 | Cook et al. | |
| 2005/0127150 | A1 * | 6/2005 | Walsh et al. | 229/117.3 |
| 2005/0187087 | A1 | 8/2005 | Walsh | |
| 2005/0274782 | A1 * | 12/2005 | Petrelli et al. | 229/217 |
| 2006/0054675 | A1 * | 3/2006 | Bennett | 229/215 |
| 2006/0243783 | A1 | 11/2006 | Spivey, Sr. et al. | |

FOREIGN PATENT DOCUMENTS

| | | | |
|---|---|---|---|
| DE | 81 10 323.9 | | 9/1981 |
| DE | 87 08 078.8 | | 10/1987 |
| DE | 94 13 813 | U1 | 10/1994 |
| EP | 1 457 425 | A1 | 9/2004 |
| FR | 2 699 150 | | 6/1994 |
| FR | 2 755 670 | | 5/1998 |
| GB | 104445 | | 3/1917 |
| GB | 1 242 356 | | 8/1971 |
| GB | 1 489 963 | | 10/1977 |
| GB | 1 584 066 | | 2/1981 |
| GB | 2 363 372 | A | 12/2001 |
| WO | WO 95/28325 | | 10/1995 |
| WO | WO 2006/124643 | A1 | 11/2006 |
| WO | WO 2006/133401 | A2 | 12/2006 |

* cited by examiner

150

CARTON WITH RECLOSABLE DISPENSER

RELATED APPLICATIONS

This application claims the benefit of U.S. Provisional Application No. 60/873,745, filed Dec. 8, 2006, the entire contents of which are hereby incorporated by reference.

BACKGROUND

Conventional paperboard cartons are known. Such cartons often include a bag or other vessel held within the interior of the paperboard carton to accommodate the carton contents. The bag may be used to store foodstuffs or other dispensable products. Conventional paperboard cartons, however, may be difficult to open and/or close, and may not close reliably. Conventional cartons may also not allow for neat and reliable dispensing of the carton contents.

SUMMARY

According to a first embodiment of the invention, a carton comprises a first end panel, a first side panel, a second end panel, a second side panel, a top panel, and a bottom panel. A reclosable dispenser is defined in a top end portion of the carton. The reclosable dispenser can be opened to allow dispensing of the carton contents.

According to one aspect of the first embodiment, the size of the dispenser opening can be varied by squeezing the side panels together by varying amounts. The amount of and rate at which product is dispensed can therefore be controlled by the user.

According to another aspect of the first embodiment, the carton can be reclosed by a closure tab sized to be received within a closure aperture.

According to yet another aspect of the invention, the carton can include a flexible vessel such as a bag in the carton interior. The bag can be used to store product in the carton.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
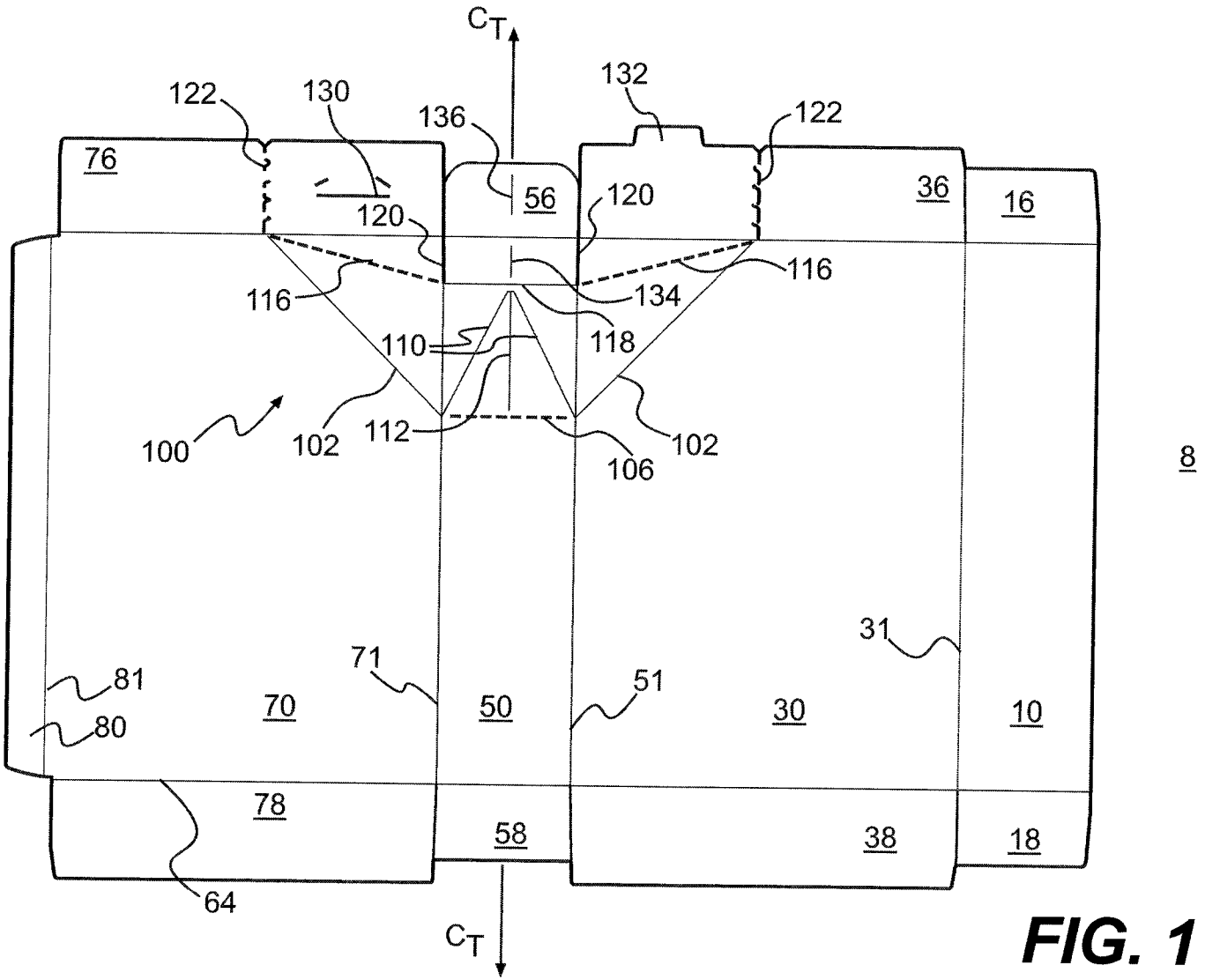
FIG. 1 is a plan view of a blank used to form a carton having a reclosable dispenser according to a first embodiment of the invention.

The present embodiments are addressed to reclosable dispensers that allow the contents of cartons to be dispensed from and retained within the cartons. In this specification, the terms "top," "side," "end," and "bottom" are used for clarity of description and to distinguish among elements in the drawings only, and are not intended to limit the scope of the invention except as specifically recited in the appended claims.

FIG. 1 is a plan view of a first, exterior side of a blank 8 used to form a carton 150 (illustrated in FIG. 2) having a reclosable dispenser 160 according to a first embodiment of the invention. The blank 8 comprises a first end panel 10 foldably connected to a first side panel 30 at a first transverse fold line 31, a second end panel 50 foldably connected to the first side panel 30 at a second transverse fold line 51, and a second side panel 70 foldably connected to the second end panel 50 at a third transverse fold line 71. An adhesive panel 80 may be foldably connected to the second side panel 70 at a fourth transverse fold line 81.

The first end panel 10 is foldably connected to a first end top flap 16 and a first end bottom flap 18. The first side panel 30 is foldably connected to a first side top flap 36 and a first side bottom flap 38. The second end panel 50 is foldably connected to a second end top flap 56 and a second end bottom flap 58. The second side panel 70 is foldably connected to a second side top flap 76 and a second side bottom flap 78. The top flaps 16, 36, 56, 76 extend along a first or top marginal area of the blank 8, and may be foldably connected along a first longitudinally extending fold line 62. The bottom flaps 18, 38, 58, 78 extend along a second or bottom marginal area of the blank 8, and may be foldably connected along a second longitudinally extending fold line 64.

The first and second longitudinal fold lines 62, 64 may be, for example, generally straight lines of disruption, or, the fold lines 62, 64 may be offset at one or more locations to account for, for example, blank thickness or other factors. When the carton 150 (FIG. 2) is erected, the top flaps 16, 36, 56, 76 close a top of the carton 150, and the bottom flaps 18, 38, 58, 78 close a bottom of the carton 150.

Figure 2:
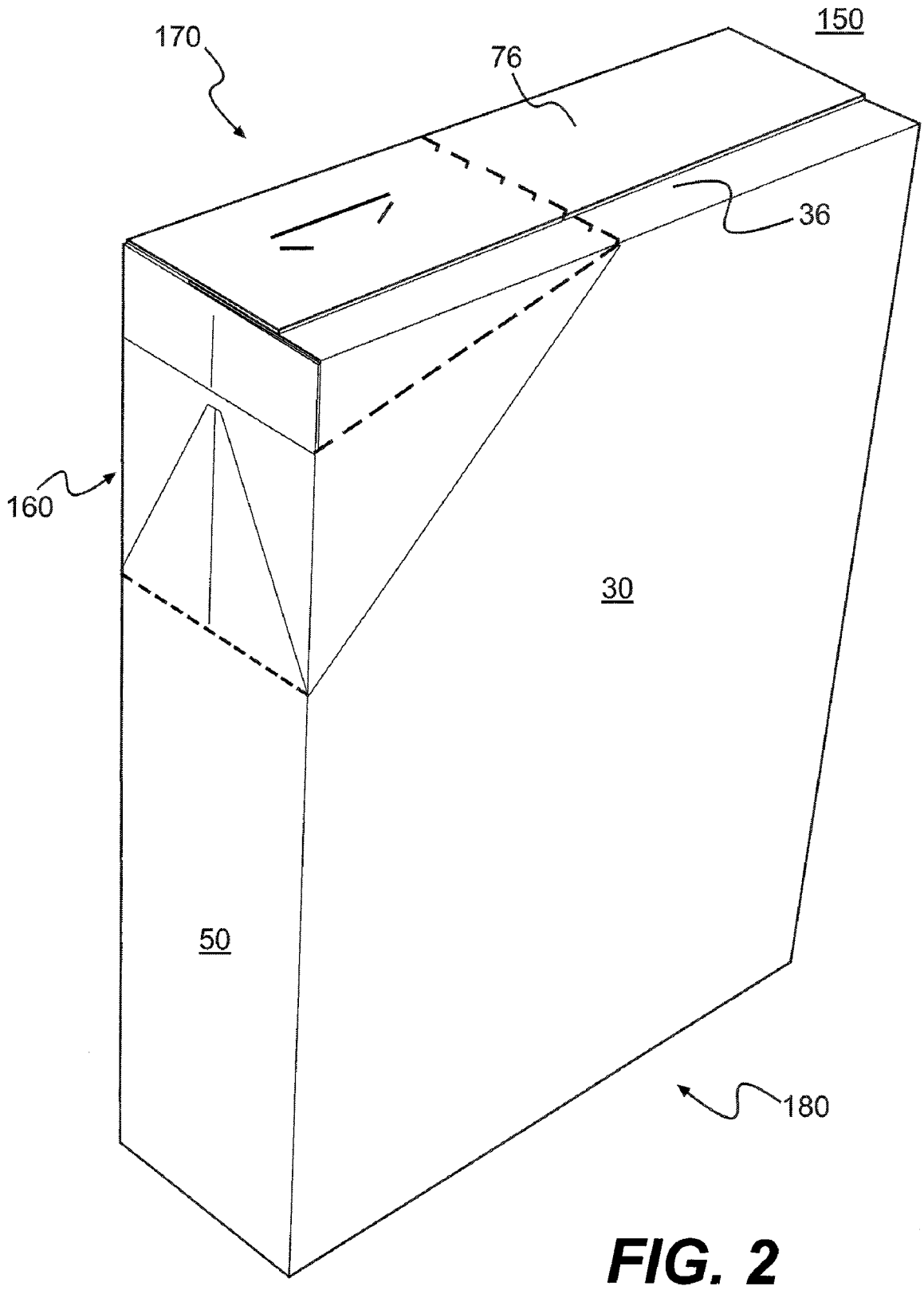
FIG. 2 illustrates the dispensing carton according to the first embodiment of the invention.

A dispenser pattern 100 is formed from a plurality of lines of disruption in an upper portion of the blank 8. The dispenser pattern 100 defines the dispenser 160 in the erected carton 150 (FIG. 2). The dispenser pattern 100 comprises a first lower oblique line of disruption 102 extending through the first side panel 30 from adjacent to the longitudinal line of disruption 62 downwardly to adjacent the transverse line of disruption 51. A second lower oblique line of disruption 102 extends through the second side panel 70 downwardly from adjacent to the longitudinal line of disruption 62 to adjacent the transverse line of disruption 71. A lower longitudinal or horizontal line of disruption 106 extends through the second end panel 50 adjacent to and between the lower ends of the pair of oblique lines of disruption 102. A pair of oblique lines of disruption 110 extend from adjacent an upper longitudinal line of disruption 118 downward in an inverse "V" arrangement to the lower longitudinal line of disruption 106. A transverse line of disruption 112 extends between the oblique lines of disruption 110 upwardly from the longitudinal line 106 to the vertex of the "V". A first upper oblique line of disruption 116 extends through the first side panel 30 from adjacent the longitudinal line of disruption 62 to adjacent the transverse line of disruption 51. A second upper oblique line of disruption 116 extends through the second side panel 70 from adjacent the longitudinal line of disruption 62 to adjacent the transverse line of disruption 71.

Still referring to FIG. 1, first and second end transverse breachable lines of disruption 120 may extend along the transverse fold lines 51, 71. First and second top transverse breachable lines of disruption 122 extend through the first and second side top flaps 36, 76 respectively. The breachable lines of disruption 122 can be, for example, tear lines, and they allow each of the flaps 36, 76 to be separated into two sections. A closure aperture 130 is formed in the second side top flap 76. The closure aperture 130 can be, for example, a breachable line of disruption such as a slit or deep score, or a knockout section of the top flap 76. A closure tab 132, which is sized to be received within the closure aperture 130, is formed at the upper edge of the first side top flap 36.

For purposes of the description presented herein, the term "line of disruption" can be used to generally refer to cuts, scores, tear lines, creases, perforations, overlapping and/or sequential combinations thereof, and other disruptions formed in a blank. A "breachable" line of disruption as disclosed in this specification refers disruptions that are intended to be breached or otherwise torn during ordinary or prescribed use of a carton. A tear line is an example of a breachable line of disruption. A "fold line" is any line of disruption that facilitates folding, bending, hinged movement, etc. of a carton or blank. In the illustrated exemplary embodiment, the lines of disruption 102, 110, 112 are scores, the lines of disruption 116 are cut-spaces, the lines 120 are 110% cuts, and the lines 31, 51, 71, 81, 118 are creases.

According to one exemplary method of construction, the carton 150 may be erected by folding the blank 8 flat about the transverse lines of disruption 31, 71 so that the exterior side of the adhesive panel 80 contacts the interior side of the first end panel 10. The first end panel 10 can be adhered to the adhesive panel 80 by, for example, glue, adhesives, or other means. The blank 8 may then be opened to have a generally tubular shape.

To close the top of the tubular carton form, the first and second end top flaps 16, 56 are folded inwardly, followed by the first side top flap 36, then the second side top flap 76. The underside of the second side top flap 76 is adhered to the exterior or upper side of the first side top flap 36. The underside of the first side top flap 36 may be adhered to one or both of the end top flaps 16, 36.

To close the bottom of the tubular carton form, the first and second end bottom flaps 18, 58 are folded inwardly, followed by the second side bottom flap 78, then the first side bottom flap 38. The underside of the first side bottom flap 38 is adhered to the exterior side of the second side bottom flap 78. Portions of one or both of the first and second side bottom flaps 38, 78 may also be adhered to the first and second end bottom flaps 18, 58.

FIG. 2 illustrates the erected carton 150, which is substantially parallelepipedal in shape. Referring also to FIG. 1, in the erected carton 150, the top flaps 16, 36, 56, 76 form a top panel 170, and the bottom flaps 18, 38, 58, 78 form a bottom panel 180. The dispenser pattern 100 defines a dispenser 160 at one upper end of the carton. A bag (not visible in FIG. 2), for example, or other flexible vessel filled with product may be inserted in the carton 150 in a conventional manner at any time before closing the top and bottom of the carton. The product may include, for example, dispensable foodstuffs, detergent, powders, etc.

Figure 3:
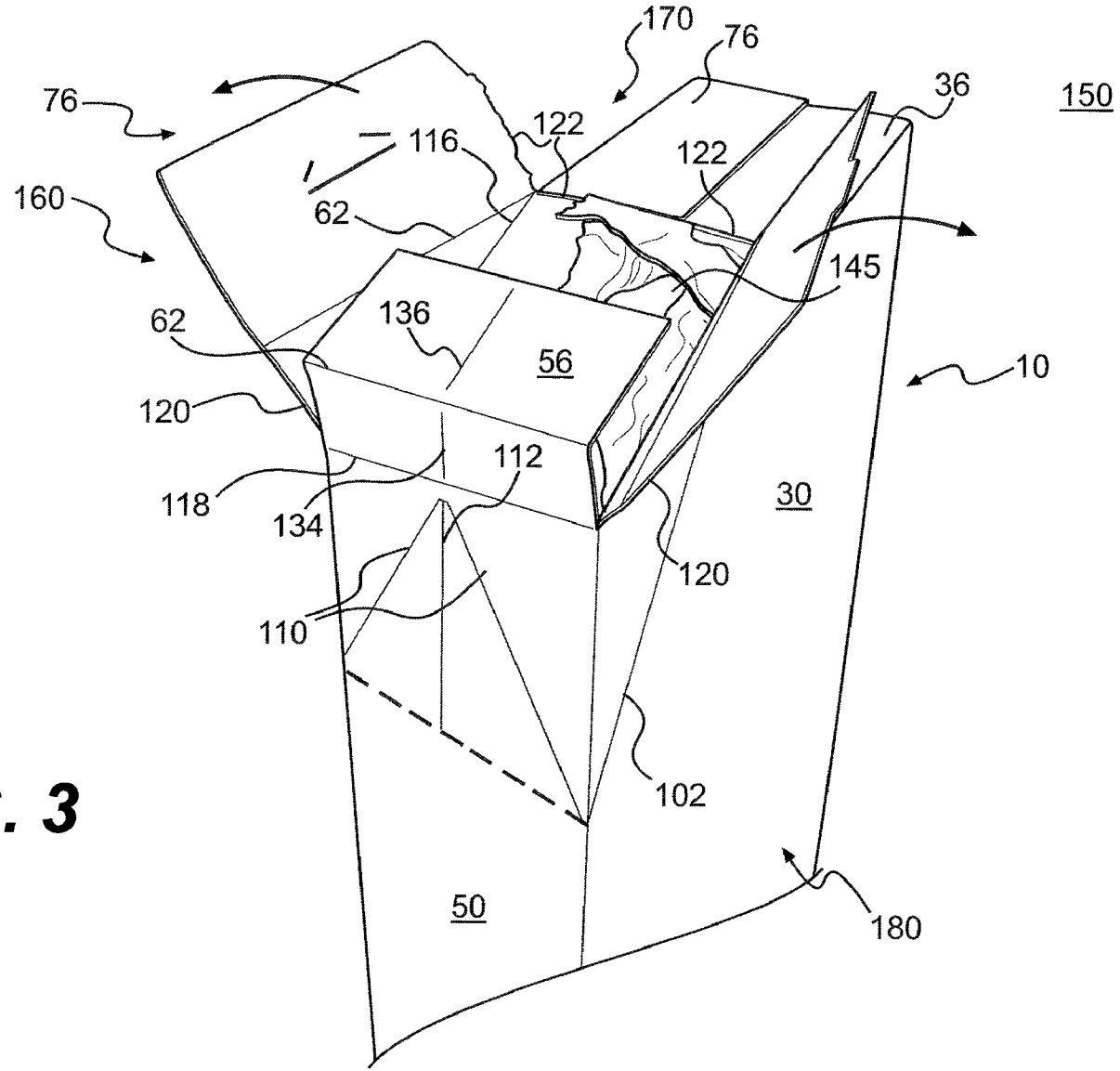
FIG. 3 illustrates opening of the carton dispenser.

FIGS. 3-6 illustrate opening of the carton dispenser 160 and placing the dispenser 160 in a dispensing configuration. In FIGS. 3-6, certain reference numbers may not be visible or included; these reference numbers can be found in FIG. 1. Referring to FIG. 3, the top panel 170 may be opened by separating the top panel 170 at the first and second side top flaps 36, 76 and tearing the top flaps 36, 76 into separate sections along the top end tear lines 122. Sections of the top flaps 36, 76 at the dispenser end of the carton 150 may then be pulled outwardly in the direction of the curved arrows as shown in FIG. 3. The carton 150 is further separated along the vertically extending lines of disruption 120 at the upper corners of the dispenser 160. This separation allows the first and second side panels 30, 70 to be pivoted outwardly about the oblique lines of disruption 116. A flexible vessel in the form of a bag 145 is accessible in the partially opened carton 150. The flexible vessel 145 may be filled with product.

Figure 4:
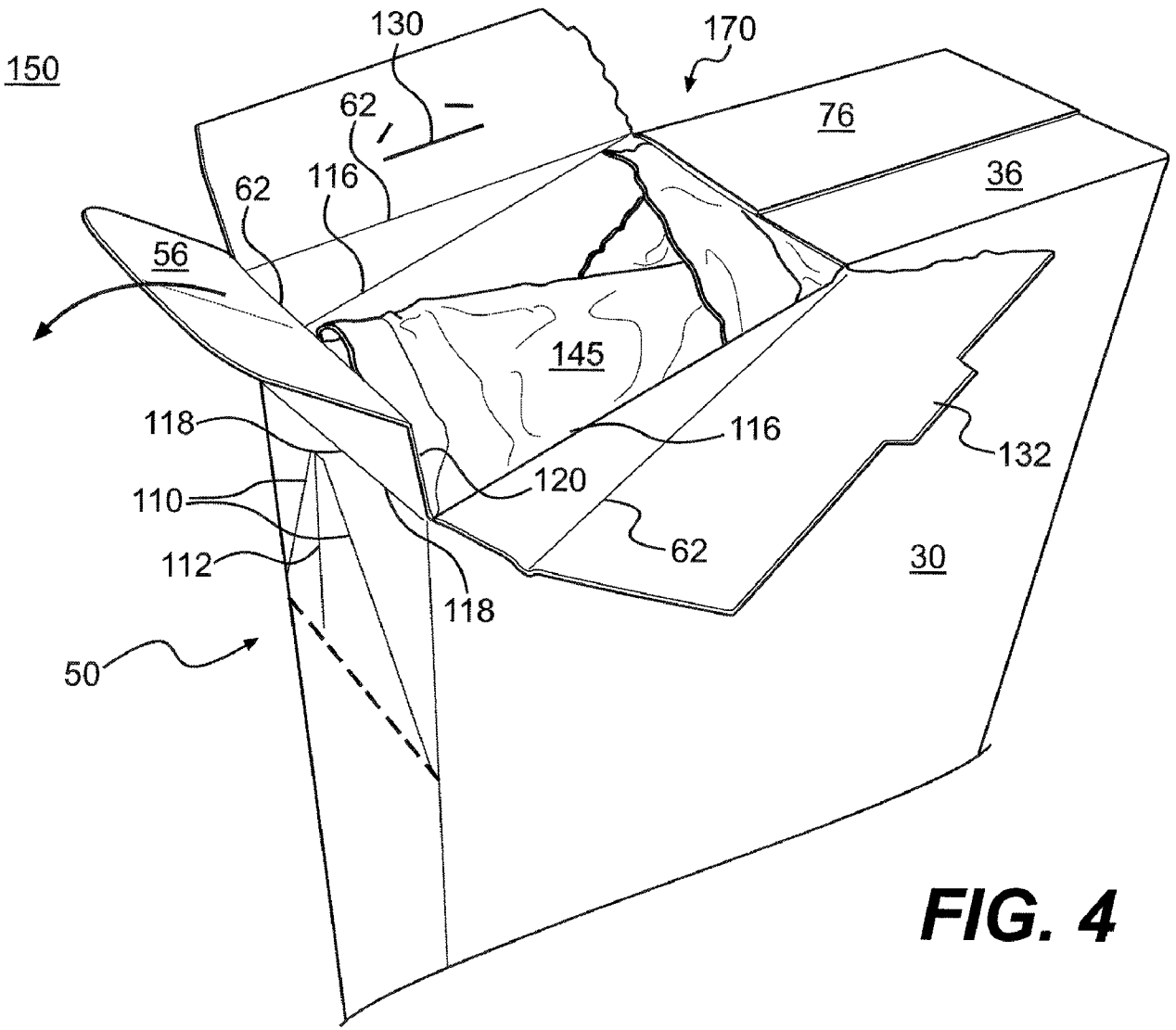
FIG. 4 illustrates opening of the carton dispenser.

Referring to FIG. 4, the second end top flap 56 at the dispenser end of the carton 150 is pivoted outwardly about the line of disruption 62 in the direction of the curved arrow. The portion of the end panel 50 connected to the top end flap 56 can also pivot outwardly about the upper longitudinal line of disruption 118 to provide easier access to the bag 145.

Figure 5:
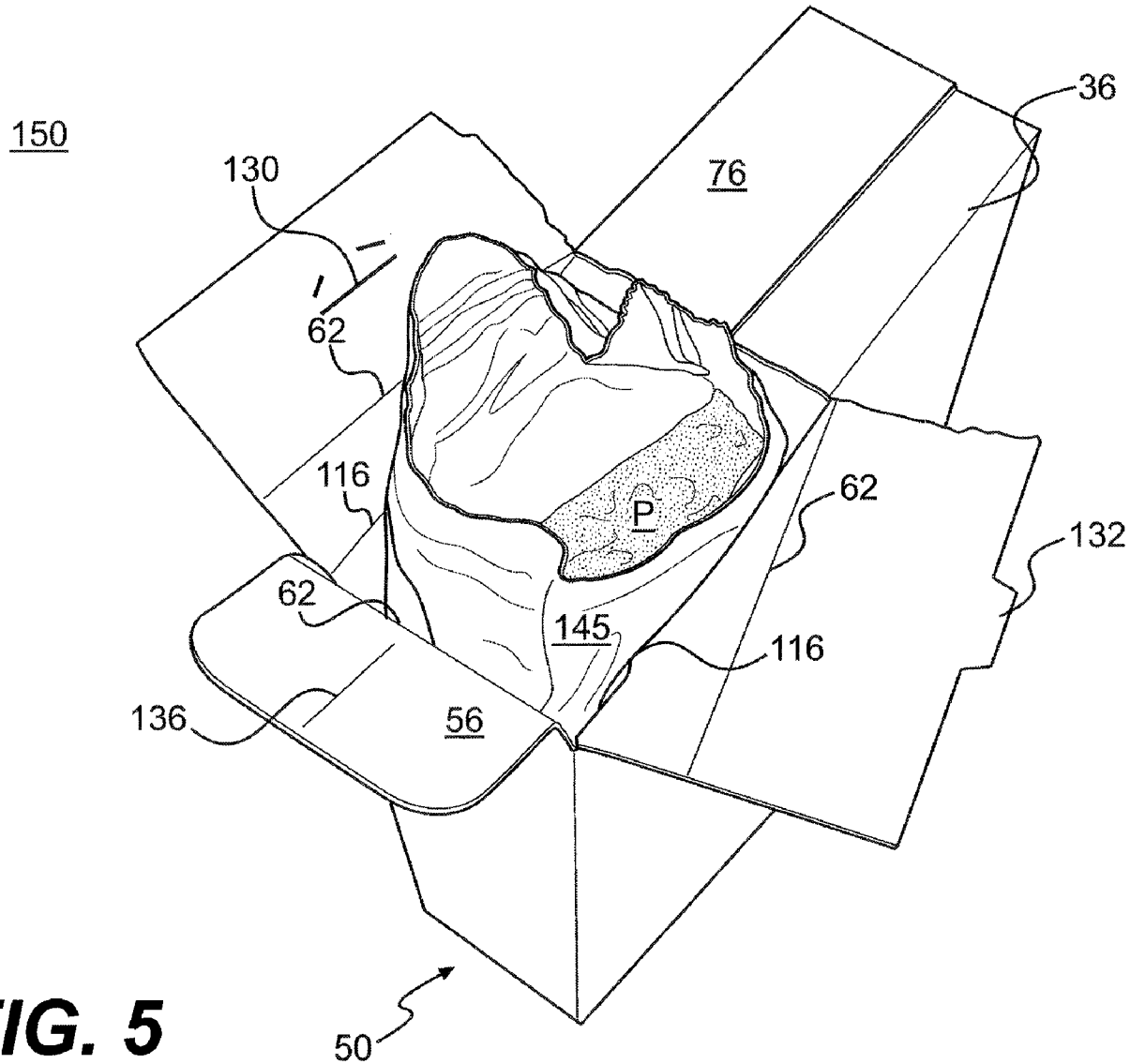
FIG. 5 illustrates opening of a flexible vessel within the carton.
Figure 6:
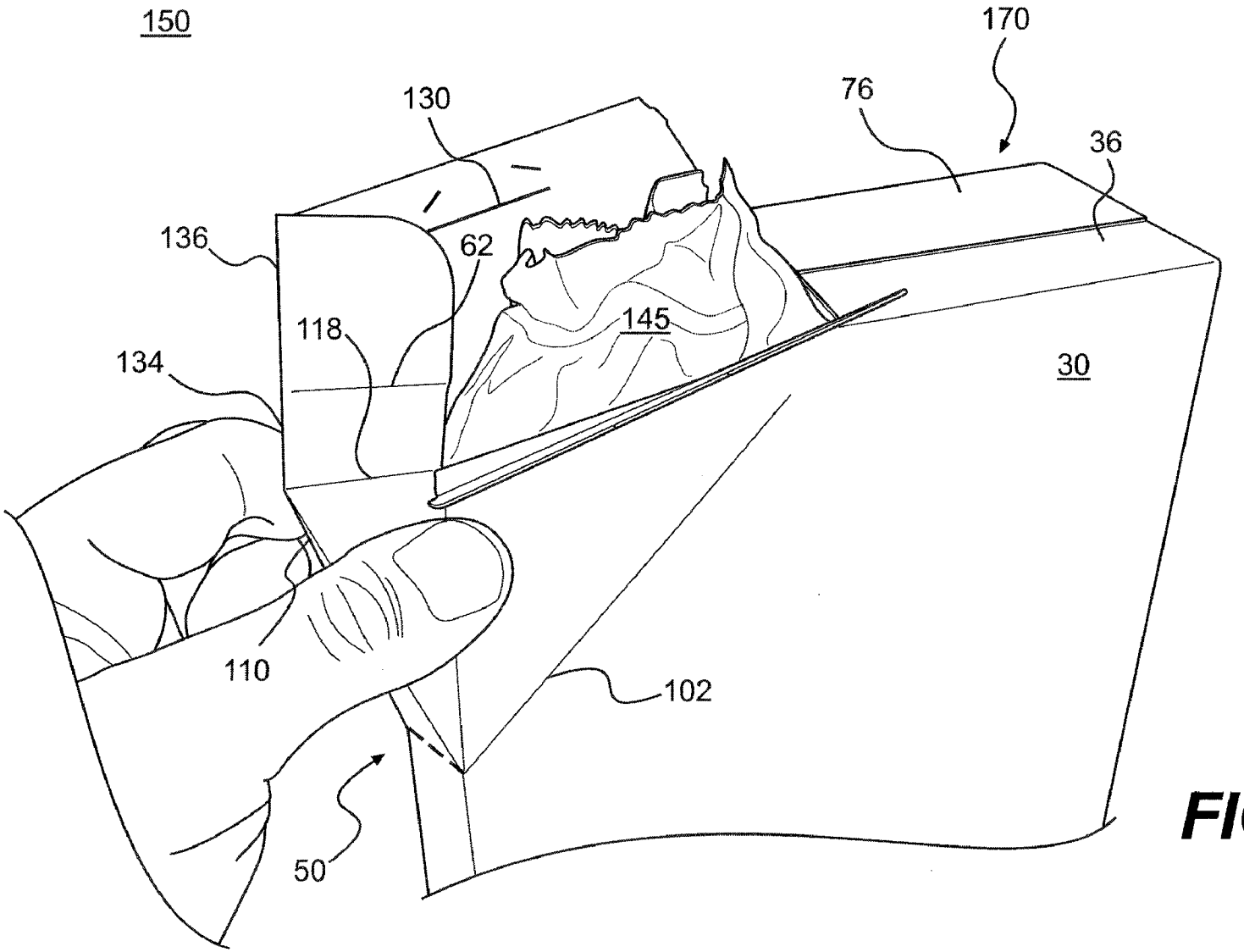
FIG. 6 illustrates placing the carton in a dispensing configuration.

Referring to FIG. 5, a top portion of the bag 145 is opened. Dispensable product P is disposed within the bag 145. Referring also to FIG. 6, the sides of the carton 150 are squeezed together so that the second end panel 50 deforms at the lines of disruption 106, 110, 112, 134 to form the spout-like dispenser 160. The first and second side panels 30, 70 also deform at the oblique lines of disruption 102, and the second end flap 56 deforms at the transverse line of disruption 136 to have a "V" profile. These deformations facilitate the dispenser 160 assuming the configuration shown in FIG. 6.

Figure 7:
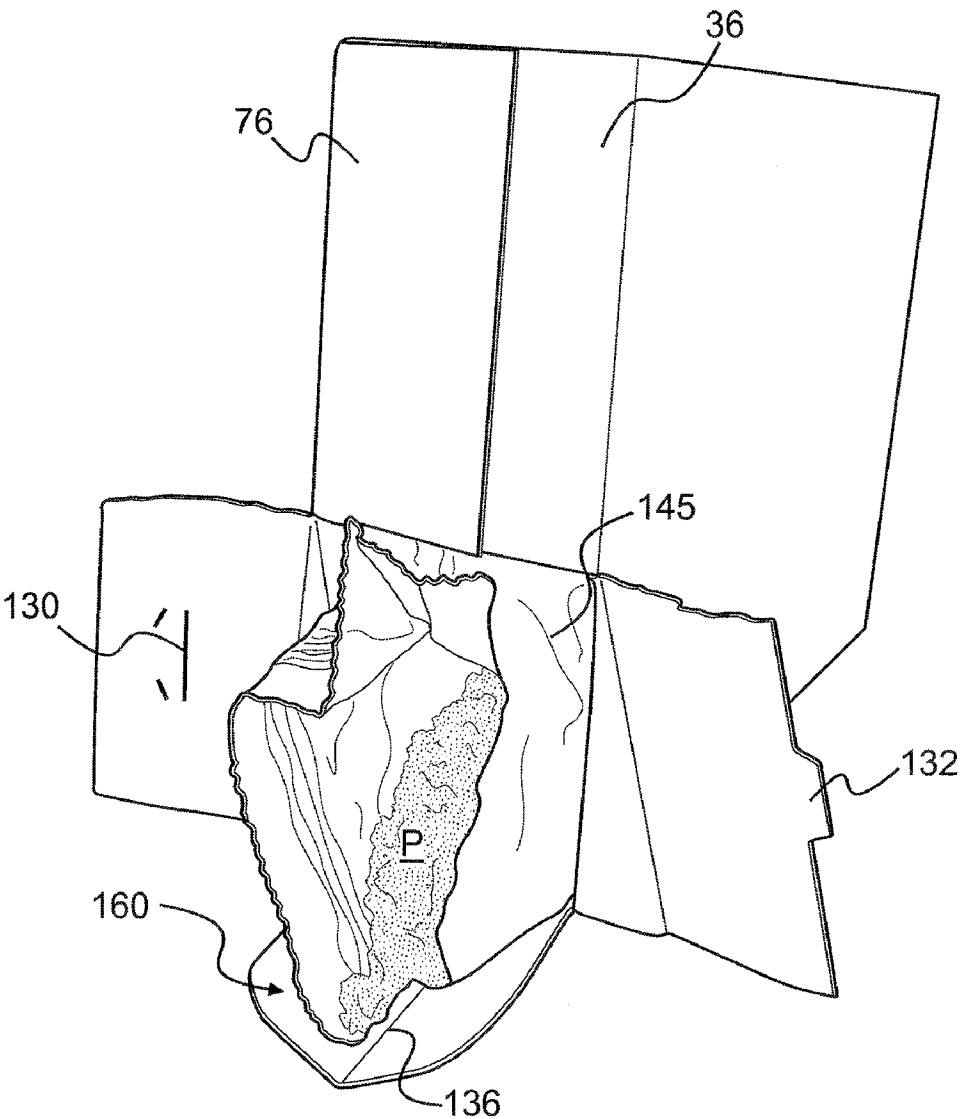
FIG. 7 illustrates the carton in the dispensing configuration.

FIG. 7 illustrates the carton 150 in the dispensing configuration. The carton 150 can be tilted so that dispensable product P in the bag 145 can be dispensed out of the carton through the opening in the top of the flexible vessel 145. The spout-like dispenser 160 has a generally V-shaped profile that allows the product P to be dispensed in a controlled manner. The side panels 30, 70 of the carton 150 can be pressed together to varying degrees, for example, to control the size of the opening of the dispenser 160.

Figure 8:
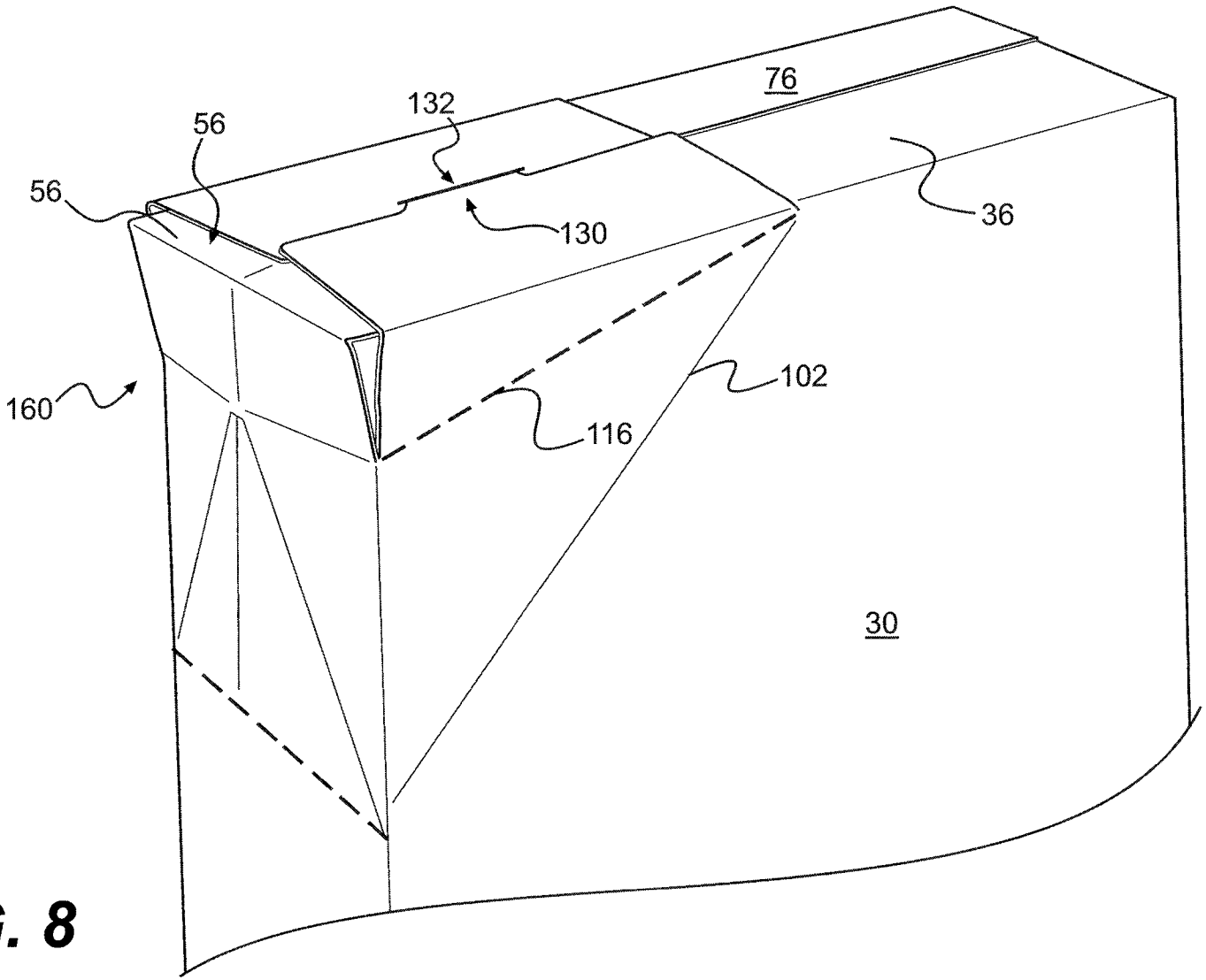
FIG. 8 illustrates the carton with the dispenser reclosed.

After dispensing product from the carton 150, the carton can be reclosed as illustrated in FIG. 8. The carton 150 may be reclosed by folding the second end top flap 56 inwardly about the line of disruption 62, and then pulling the side panels 30, 70 and the dispenser portions of the side top flaps 36, 76 back over the top end of the carton. The closure tab 132 may be engaged with the closure aperture 130 to close the top of the carton 150. The closure aperture 130 can be a 100% cut such as a slit in which the tab 132 can be received, or a cut interspersed with nicks that can be breached by insertion of the tab 132.

Alternatively, the side top flaps 36, 76 can be reclosed by the closure tab 132 and closure aperture 130 and the second end top flap 56 subsequently tucked under the reclosed flaps 36, 76. The carton contents are securely retained by the engaged portions of the side top flaps 36, 76 when the carton 150 is in its reclosed configuration.

To reopen the dispenser 160, the closure tab 132 can be disengaged from the closure aperture 130 and the dispenser end of the carton 150 again deformed as shown in FIG. 6. The carton 150 can be repeatedly placed in the dispensing configuration and reclosed. Because only a portion of the top flaps 36, 76 are opened for dispensing, the carton retains greater rigidity after opening.

According to the above-described embodiment of the invention, the reclosable dispenser 160 provides for controlled dispensing of product from the carton 150. The size of the opening of the dispenser 160 can be selectively varied by the user to any desired degree. After dispensing product, the reclosable dispenser 160 can be reclosed to secure the carton contents after dispensing.

In the exemplary embodiment discussed above, the blank may be formed from, for example, clay-coated newsprint (CCN). In general, the blank may be constructed of paperboard and/or paper-based materials, having a caliper of at least about 12, for example, so that it is heavier and more rigid than ordinary paper. The blank, and thus the carton, can also be constructed of other materials having properties suitable for enabling the carton to function at least generally as described above. Solid unbleached sulfate (SUS) board, for example, may be used to form cartons in accordance with the principles of the present invention.

The interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank, or laminated to or coated with one or more sheet-like materials at selected panels or panel sections.

The term "line" as used herein includes not only straight lines, but also other types of lines such as curved, curvilinear or angularly displaced lines.

The above embodiments may be described as having one or panels adhered together by glue. The term "glue" is intended to encompass all manner of adhesives commonly used to secure paperboard carton panels in place.

In the present specification, a "panel" or "flap" need not be flat or otherwise planar. A "panel" or "flap" can, for example, comprise a plurality of interconnected generally flat or planar sections.

It will be understood by those skilled in the art that while the present invention has been discussed above with reference to preferred embodiments, various additions, modifications, and variations can be made thereto without departing from the spirit and scope of the present invention.

What is claimed is:

1. A carton, comprising: a first end panel; a first side panel; a second end panel; a second side panel; a first side top flap foldably connected to the first side panel; a second side top flap foldably connected to the second side panel; and a dispenser defined at least partially by a dispenser pattern of lines of disruption in the second end panel, the first side panel, and the second side panel, the dispenser pattern comprising: a first tear line in the first side top flap; a second tear line in the second side top flap; at least one first oblique line of disruption extending across the first side panel; at least one second oblique line of disruption extending across the second side panel; and at least one line of disruption in the second end panel; wherein the at least one first oblique line of disruption in the first side panel comprises an upper oblique line of disruption and a lower oblique line of disruption, each of the upper oblique line of disruption and lower oblique line of disruption extends across the first side panel, the upper oblique line of disruption and the lower oblique line of disruption are first oblique lines of disruption, the at least one second oblique line of disruption in the second side panel comprises a second upper oblique line of disruption and a second lower oblique line of disruption, each of the second upper oblique line of disruption and the second lower oblique line of disruption extends across the second side panel, the first upper oblique line of disruption extends across the first side panel from adjacent to a longitudinal line of disruption at a first edge of the first side panel to an adjacent transverse line of disruption at a second edge of the first side panel, and the first lower oblique line of disruption extends across the first side panel from the longitudinal line of disruption at the first edge of the first side panel to the adjacent transverse line of disruption at the second edge of the first side panel.

2. The carton of claim 1, wherein the at least one line of disruption in the second end panel comprises a lower longitudinal line of disruption.

3. The carton of claim 2, wherein the at least one line of disruption in the second end panel further comprises a pair of oblique lines of disruption.

4. The carton of claim 3, wherein the at least one line of disruption in the second end panel further comprises a transverse line of disruption between the pair of oblique lines of disruption.

5. The carton of claim 2, wherein a pair of transverse fold lines define side edges of the second end panel, and wherein the dispenser pattern further comprises a transverse breachable line of disruption along each transverse fold line.

6. The carton of claim 1, wherein the first side top flap includes a projection and the second side top flap includes an aperture sized to receive the projection.

7. The carton of claim 1, further comprising a first end top flap foldably connected to the first end panel and a second end top flap foldably connected to the second end panel.

8. The carton of claim 7, further comprising a plurality of bottom end flaps.

9. The carton of claim 1, further comprising a flexible vessel containing dispensable product.

10. A substantially parallelepipedal carton, comprising: a flexible bag containing dispensable product; a first end panel; a first side panel; a second end panel; a second side panel; a bottom panel; a first side top flap foldably connected to the first side panel; a second side top flap foldably connected to the second side panel; and a dispenser defined at least partially by a dispenser pattern of lines of disruption, the dispenser pattern comprising: at least one first oblique line of disruption extending across the first side panel; at least one second oblique line of disruption extending across the second side panel; a lower longitudinal line of disruption in the second end panel; and a pair of oblique lines of disruption in the second end panel; wherein the at least one first oblique line of disruption in the first side panel comprises an upper oblique line of disruption and a lower oblique line of disruption, each of the upper oblique line of disruption and lower oblique line of disruption extends across the first side panel, the upper oblique line of disruption and the lower oblique line of disruption are first oblique lines of disruption, the at least one second oblique line of disruption in the second side panel comprises a second upper oblique line of disruption and a second lower oblique line of disruption, each of the second upper oblique line of disruption and the second lower oblique line of disruption extends across the second side panel, the first upper oblique line of disruption extends across the first side panel from adjacent to a longitudinal line of disruption at a first edge of the first side panel to an adjacent transverse line of disruption at a second edge of the first side panel, and the first lower oblique line of disruption extends across the first side panel from the longitudinal line of disruption at the first edge of the first side panel to the adjacent transverse line of disruption at the second edge of the first side panel.

11. The carton of claim 10, wherein the dispenser pattern further comprises a transverse line of disruption between the pair of oblique lines of disruption in the second end panel.

12. The carton of claim 10, wherein the dispenser pattern further comprises: a first tear line in the first side top flap; a second tear line in the second side top flap.

13. The carton of claim 12, wherein a pair of transverse fold lines define side edges of the second end panel, and wherein the dispenser pattern further comprises a transverse breachable line of disruption along each transverse fold line.

14. The carton of claim 10, further comprising: a first end top flap foldably connected to the first end panel; a second end top flap foldably connected to the second end panel; and a plurality of bottom end flaps.

15. The carton of claim 1, wherein the second upper oblique line of disruption extends through the second side panel from adjacent to a longitudinal line of disruption at a first edge of the second side panel to an adjacent transverse line of disruption at a second edge of the second side panel, and the second lower oblique line of disruption extends through the second side panel from the longitudinal line of disruption at the first edge of the second side panel to the adjacent transverse line of disruption at the second edge of the second side panel.

16. The carton of claim 1 wherein the first upper oblique line of disruption and the first lower oblique line of disruption extend from an intersection of a tear line in the first side top flap with the longitudinal line of disruption at the first edge of the first side panel.

17. The carton of claim 15 wherein the second upper oblique line of disruption and the second lower oblique line of disruption extend from an intersection of a tear line in the second side top flap with the longitudinal line of disruption at the first edge of the second side panel.

18. The carton of claim 1 wherein the first lower oblique line of disruption extends through the first side panel to a lower transverse line of disruption in the second end panel and the second lower oblique line of disruption extends through the second side panel to the lower transverse line of disruption.

19. The carton of claim 18 wherein the first upper oblique line of disruption extends through the first side panel to an upper transverse line of disruption in the second end panel and the second upper oblique line of disruption extends through the second side panel to the upper transverse line of disruption.

* * * * *